US005090483A

United States Patent [19]

Theurer et al.

[11] Patent Number: 5,090,483

[45] Date of Patent: * Feb. 25, 1992

[54] BALLAST SEPARATING DEVICE FOR BALLAST CLEANING MACHINE

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[ * ] Notice: The portion of the term of this patent subsequent to Feb. 25, 2009 has been disclaimed.

[21] Appl. No.: 539,782

[22] Filed: Jun. 18, 1990

[30] Foreign Application Priority Data

Jul. 18, 1989 [AT] Austria ..... 1736/89

[51] Int. Cl.[5] ..... E01B 27/10

[52] U.S. Cl. ..... 171/16; 37/104; 37/84; 104/7.1; 104/7.3; 104/279

[58] Field of Search ..... 37/104, 105, 106, 107; 171/16; 104/2, 7.1, 7.2, 7.3, 279

[56] References Cited

U.S. PATENT DOCUMENTS

| | | | |
|---|---|---|---|
| 3,179,062 | 4/1965 | Christoff | 104/7.3 |
| 3,957,000 | 5/1976 | Plasser et al. | 104/2 |
| 3,976,142 | 8/1976 | Plasser et al. | 104/2 |
| 4,043,398 | 8/1977 | Folser et al. | 104/7.1 |
| 4,266,615 | 5/1981 | Theurer et al. | 104/2 |
| 4,430,944 | 2/1984 | Theurer | 104/2 |
| 4,432,284 | 2/1984 | Theurer et al. | 104/2 |
| 4,538,687 | 1/1985 | Theurer et al. | 104/2 |
| 4,705,115 | 11/1987 | Whitaker, Jr. . | |
| 4,799,430 | 1/1989 | Theurer | 104/2 |
| 4,809,614 | 3/1979 | Theurer et al. | 104/7.2 |
| 4,911,246 | 3/1990 | Theurer et al. | 104/7.1 |

FOREIGN PATENT DOCUMENTS

| | | | |
|---|---|---|---|
| 159186 | 2/1983 | German Democratic Rep. | 104/2 |
| 970010 | 1/1962 | United Kingdom . | |

OTHER PUBLICATIONS

Railway Track & Structures, Oct. 1987, pp. 17-21.

*Primary Examiner*—Randolph A. Reese
*Assistant Examiner*—Spencer Warnizk
*Attorney, Agent, or Firm*—Collard, Roe & Galgano

[57] ABSTRACT

In combination with a mobile ballast cleaning machine advancing continuously in an operating direction along a railroad track, which comprises a ballast excavating chain including a transverse course extending under the track and driven to excavate a transversely extending portion of the ballast bed during the continuous advancement of the machine: a device connected to the machine for continuous advancement therewith and arranged to receive ballast deposited on the ballast bed and the track ties ahead of the transverse ballast excavating chain course and to discharge the received ballast in the transversely extending excavated ballast bed portion, the device comprising a ballast receiving and discharging element extending in the direction of the track, and a vertical adjustment drive arranged to lower the element onto the upper surfaces of the ties between the rails whereby the ballast deposited on the ballast bed and the track ties is separated from the underlying ballast bed and is received on the element during the continuous advancement of the machine and the element connected thereto, the ballast receiving and discharging element having a discharge end above the transverse ballast excavating chain course for discharging the received ballast in the excavated ballast bed portion immediately therebehind in the operating direction.

18 Claims, 2 Drawing Sheets

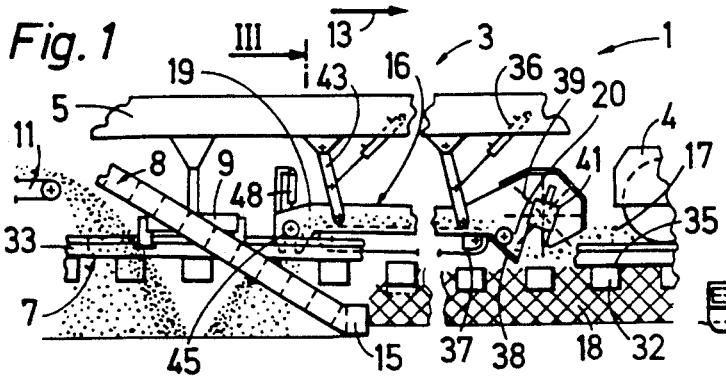
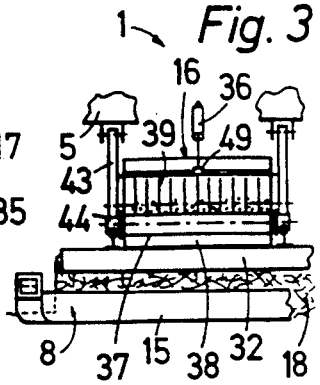
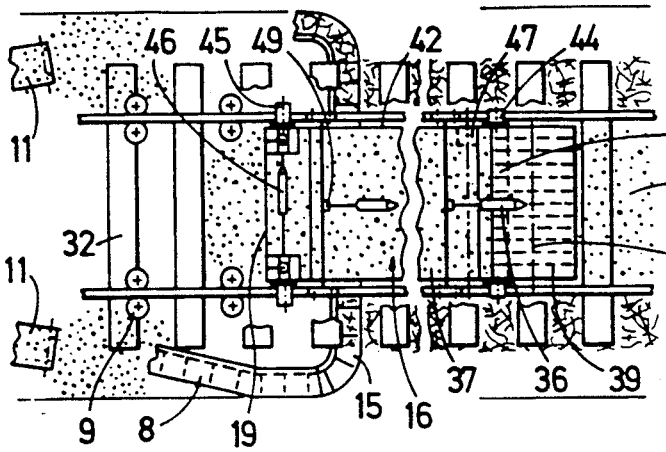
Fig. 2
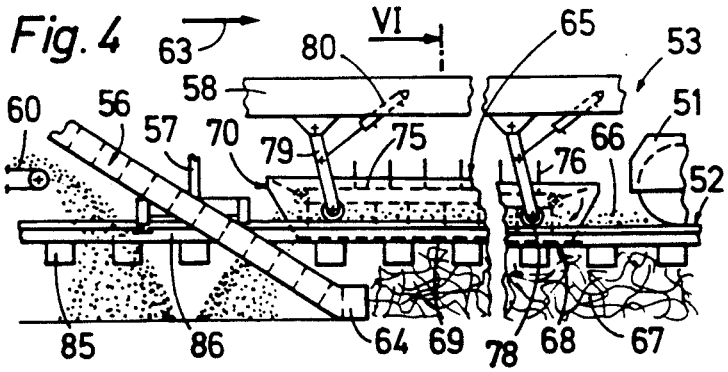
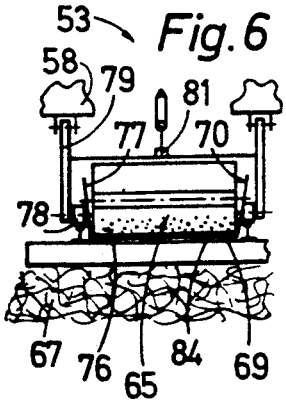
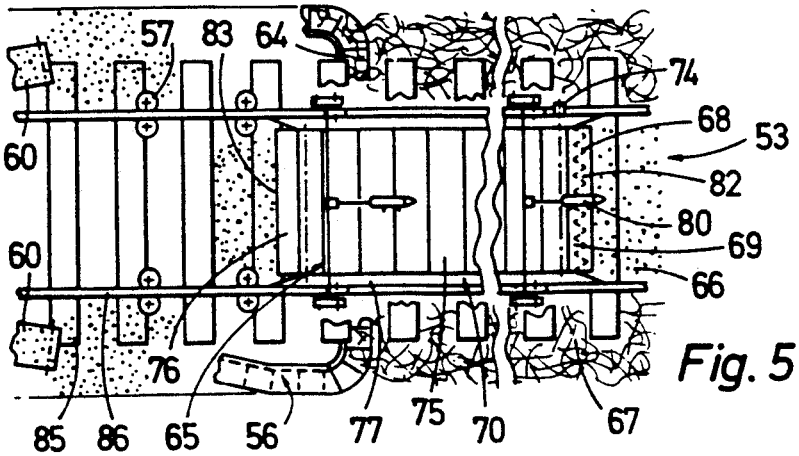
Fig. 5

BALLAST SEPARATING DEVICE FOR BALLAST CLEANING MACHINE

BACKGROUND OF THE INVENTION

1. Field of the Invention

The present invention relates to a mobile ballast cleaning machine advancing continuously in an operating direction along a railroad track comprised of two rails fastened to the upper surfaces of a succession of ties supported on a ballast bed and comprising a machine frame and mounted on the machine frame: a ballast excavating chain including a transverse course extending under the track and driven to excavate a transversely extending portion of the ballast bed during the continuous advancement of the machine, and a device connected to the machine for continuous advancement therewith and arranged to receive ballast deposited on the ballast bed and the track ties ahead of the transverse ballast excavating chain course in the operating direction and to discharge the received ballast in the transversely extending excavated ballast bed portion.

2. Description of the Prior Art

During the last few years, the cleaning and rehabilitation of railroad track supporting ballast beds has become more difficult not only because the rehabilitation work requires train traffic to be stopped and thus to interrupt the ever more frequent schedules but also because economical considerations make it desirable to clean not only the upper ballast layer but at the same time to clean the entire ballast bed down to the subgrade in a single operation while the track is lifted. This considerably increases the amount of ballast that must be handled by the machine and correspondingly decreases the output, i.e. the speed of advance, of such ballast cleaning machines.

In substance, rehabilitation of the railroad track ballast bed comprises excavating the dirty or encrusted ballast, cleaning the excavated ballast, returning and redistributing the cleaned ballast, and conveying the waste away from the rehabilitation site. This has been done with mobile ballast cleaning machines of the above-described type. The transverse course of the ballast excavating chain extending under the raised track generally excavates the ballast across the entire ballast bed width in a single pass, which forces the machine to advance only very slowly even if its maximal operating capacity is used. The forward speed of the machine decreases in proportion to the depth of excavation, i.e. the amount of ballast being excavated. Furthermore, because of the very inconvenient train traffic interruption caused by the track rehabilitation work, the work is performed relatively rarely so that the ballast becomes heavily encrusted, preventing drainage and making the ballast cleaning more difficult. It has been proposed to facilitate drainage without cleaning the ballast along the entire ballast bed width by using shoulder ballast cleaning machines using shoulder ballast excavating devices at each side of the track. Such machines work at a forward speed somewhat exceeding that of mobile ballast cleaning machines designed to recondition the ballast along the entire width of the ballast bed.

U.S. Pat. No. 4,538,687, dated Sept. 3, 1985, discloses a mobile ballast cleaning machine designed to excavate ballast along the entire width of the ballast bed and, to increase its output, the machine is equipped with a double ballast cleaning screen and an auxiliary conveying chain for conveying the excavated ballast from the transverse course of the ballast excavating chain extending under the raised track to the screen. This makes it possible to clean a larger volume of ballast at an increased forward speed of the machine. A track lifting device is arranged immediately adjacent the transverse excavating chain course and the excavated ballast is conveyed to the double ballast cleaning screen arrangement by the ascending course of the chain and by the auxiliary conveying chain, thus greatly increasing the capacity of the machine. The transverse excavating chain course excavates and conveys the dirty ballast to the shoulder while creating an excavated ballast bed gap under the raised track, and the ascending excavating chain course and the auxiliary conveying chain convey the excavated ballast to the ballast cleaning screen arrangement. During the ballast reconditioning operation and forward movement of the machine, the track is continuously raised so that it is possible to use an excavating chain of a larger or smaller operating height under the track, depending on the desired depth of excavation. The cleaned portion of the ballast is conveyed from the double ballast cleaning screen arrangement and redistributed immediately behind the transverse excavating chain course in the excavated ballast bed gap while the waste portion is conveyed from the screen arrangement by a conveyor arrangement to freight cars preceding the mobile ballast cleaning machine in the operating direction. This machine has been successfully used and provides high-efficiency reconditioning of a ballast bed.

British patent No. 970,010, published Sept. 16, 1964, discloses a mobile ballast cleaning machine arrangement comprising two machines coupled to each other for common movement in an operating direction, each machine comprising a machine frame supported on two undercarriages with a relatively short wheel base, the leading machine being equipped with two shoulder ballast excavating devices with an associated ballast cleaning screen and the trailing machine being equipped with a ballast excavating chain having a transverse chain course insertable under the track and an associated ballast cleaning screen, and each machine also having conveyor means for redistributing the cleaned ballast and for removing the waste from the respective ballast cleaning screens. This machine arrangement, which has no track lifting means, enables the ballast from the center portion and the shoulder portions of the ballast bed to be excavated and cleaned in a single pass, and a common conveyor band enables the redistributing means on the trailing machine to redistribute the cleaned ballast in the ballast bed gap excavated by the transverse ballast excavating chain course. When the shoulder ballast excavating machine is used alone, the excavated shoulder ballast is cleaned and the cleaned ballast is redistributed by discharge chutes at the same shoulder. When the machines are coupled together, the forward speed of the machine arrangement is quite slow.

U.S. Pat. No. 4,705,115, dated Nov. 10, 1987, discloses a structurally complex mobile ballast reconditioning machine with two shoulder ballast excavating ditcher wheels preceding a relatively wide undercutter revolving in a transverse plane extending vertically with respect to the track axis for excavating ballast from beneath the track. The relatively large ditcher wheels excavate the shoulder ballast and convey it up to a level extending at about half the height of the machine whence it is conveyed across the rails towards the center of the track by transversely extending conveyor bands and thence by conveyor bands extending in the track direction across the endless undercutter chain to be discharged immediately behind the undercutter on the center portion of the ballast bed without being cleaned. The ballast excavated by the undercutter is conveyed to a ballast screen cleaner and the cleaned ballast is discharged in the excavated track shoulders. In other words, only the ballast from the center portion of the ballast bed beneath a track which is not raised is cleaned with this machine while the shoulder ballast excavated by relatively complex bucket conveyors and conveyed by cumbersome conveyor arrangements is redistributed to the center portion of the ballast bed without being cleaned.

Finally, an article in "Railway Track & Structures", October 1987, pages 17, 18, 20 and 21, discloses a ballast cleaning system comprised of two independently movable ballast cleaning machines. The leading machine is one according to U.S. Pat. No. 4,705,115, with two shoulder ballast excavating ditcher wheels and a centrally arranged ballast cleaning screen. The shoulder ballast excavated by the ditcher wheels is conveyed to the ballast cleaning screen arrangement and is conveyed therefrom to the shoulders for intermediate storage. The cleaned ballast is then received by the two ditcher wheels on the trailing machine, is conveyed across the track rails and back beyond the undercutter on this machine to be deposited below the track, which has not been raised, in the ballast bed gap excavated by the undercutter chain in the center of the ballast bed. The ballast excavated by the undercutter in the center of the ballast bed is cleaned and the cleaned ballast is discharged in the excavated track shoulders. Thus, the two large ditcher wheels with the two transverse conveyor bands and the longitudinally extending conveyor band reaching at half the height of the machine beyond the transversely extending undercutter constitute a device in a mobile ballast cleaning machine for receiving a ballast portion preceding the undercutter and for depositing this ballast portion in the gap of the ballast bed excavated by the undercutter. The entire system is structurally quite complex and requires four large ditcher wheels, two depositions of the cleaned ballast laterally of the track and two complex redistributions thereof, as well as a time- and labor-consuming vertical, transverse and longitudinal ballast conveyance beyond the endless undercutter chain while affording no increase in the efficiency of the machine and its rapid forward movement in view of the fact that the track is not raised during the ballast reconditioning operation.

SUMMARY OF THE INVENTION

It is the primary object of this invention to provide a cleaned ballast portion separating device in combination with a mobile ballast cleaning machine of the hereinabove described type, which is simple in construction and operation for efficiently and rapidly receiving the cleaned ballast portion from the second ballast cleaning screen and discharging it in the excavated ballast bed portion.

This and other objects are accomplished according to the invention in combination with a mobile ballast cleaning machine advancing continuously in an operating direction along a railroad track comprised of two rails fastened to the upper surfaces of a succession of ties supported on a ballast bed and comprising a machine frame and a ballast excavating chain mounted on the machine frame, the chain including a transverse course extending under the track and driven to excavate a transversely extending portion of the ballast bed during the continuous advancement of the machine, with a device connected to the machine for continuous advancement therewith and arranged to receive ballast deposited on the ballast bed and the track ties ahead of the transverse ballast excavating chain course in the operating direction and to discharge the received ballast in the transversely extending excavated ballast bed portion, which device comprises a ballast receiving and discharging element extending in the direction of the track, and a vertical adjustment drive means linking the ballast receiving and discharging element to the machine frame and arranged to lower the element onto the upper surfaces of the ties between the rails whereby the ballast deposited on the ballast bed and the track ties is separated from the underlying ballast bed and is received on the element during the continuous advancement of the machine and the element connected thereto, the ballast receiving and discharging element having a discharge end above the transverse ballast excavating chain course for discharging the received ballast in the excavated ballast bed portion immediately therebehind in the operating direction.

This structurally very simple device permits a coarse separation of an upper, cleaned ballast portion layer from the underlying, uncleaned ballast bed layer and conveyance of the separated cleaned ballast portion over the transverse excavating chain course for discharge into the excavated track section therebehind so that the excavating chain needs to excavate only the underlying ballast for cleaning on the first ballast cleaning screen. In this respect, it is of advantage that the device separates the cleaned ballast portion from the second ballast cleaning screen only temporarily from the underlying ballast bed and discharges it while advancing at the same speed as the machine immediately above the upper surfaces of the track ties, with a minimal power requirement. The upper, cleaned ballast portion layer is barely longitudinally displaced but is merely lifted slightly off the underlying ballast bed as the machine and the device advance in tandem. Furthermore, since the ballast separating device is arranged centrally between the track rails, it has the additional advantage that the temporarily stored cleaned ballast portion is concentrated in a relatively wide, central track section laterally delimited by the track rails, which avoids the need for a complicated vertical, transverse and longitudinal conveyance of the shoulder ballast across the rails to the center portion of the ballast bed. One simple ballast separating device suffices for the machine.

BRIEF DESCRIPTION OF THE DRAWING

The above and other objects, advantages and features of the invention will become more apparent from the following description of certain now preferred embodiments thereof, taken in conjunction with the accompanying, somewhat schematic drawing wherein FIGS. 1, 2 and 3 are, respectively, fragmentary side, top and cross sectional views showing one embodiment of a ballast separating device according to the present invention;

FIGS. 4, 5 and 6 are like respective views of another embodiment;

DETAILED DESCRIPTION OF PREFERRED EMBODIMENTS

Figure 7:
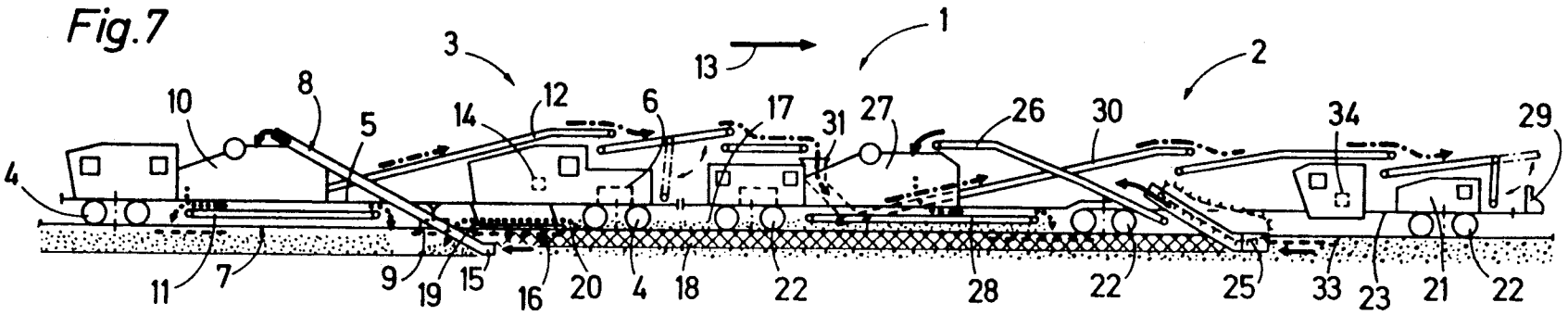
FIGS. 7 and 8 respectively show diagrammatic side and top views of a mobile ballast cleaning machine equipped with the separating device of FIGS. 1 to 3.

Referring now to the drawing and first to the embodiment illustrated in FIGS. 1-3, 7 and 8, FIGS. 7 and 8 show mobile machine 1 for receiving ballast 18 from a ballast bed supporting railroad track 7, for cleaning the received ballast and for redistributing the cleaned ballast to the ballast bed. The machine advances continuously in an operating direction indicated by arrow 13 along the railroad track which is comprised of two rails 33 fastened to upper surfaces 35 of a succession of ties 32. Machine 1 comprises machine frame means 5, 23 supported for mobility on track 7 in the operating direction and propelled by drive 6. In the illustrated embodiment, machine 1 is comprised leading shoulder cleaning machine 2 and trailing ballast cleaning machine 3, machine 2 comprising machine frame 23 supported on undercarriages 22, 22 and machine 3 comprising enlongated machine frame 5 supported on widely spaced undercarriages 4, 4 and coupled to machine frame 23. Track lifting device 9 is mounted on machine frame 5 substantially centrally between undercarriages 4, 4 and endless ballast excavating chain 8 is mounted on the machine frame adjacent to the track lifting device and includes transverse course 15 insertable under track 7 for excavating ballast 18 from a transverse section of the ballast bed and an ascending course for conveying the excavated ballast.

First vibratory ballast cleaning screen 10 is mounted on elongated machine frame 5 behind ballast excavating chain 8 and is arranged to receive the conveyed ballast from the ascending course of the chain and to separate the excavated ballast into a cleaned portion and a waste portion. All the operating drives, including the propelling drive enabling the machine to advance continuously in the operating direction indicated by arrow 13, are controlled from central control panel 14.

According to this invention, device 16 is connected to machine 1 for continuous advancement therewith and is arranged to receive ballast 17 deposited on ballast bed 18 and the track ties ahead of transverse ballast excavating chain course 15 in the operating direction and to discharge the received ballast in a transversely extending excavated ballast bed portion. Device 16 comprises a ballast receiving and discharging element extending in the direction of track 7, vertical adjustment drive means 36 linking the ballast receiving and discharging element to machine frame 5 and arranged to lower the element onto upper surfaces 35 of ties 32 between rails 33 whereby ballast 17 deposited on ballast bed 18 is separated from the underlying ballast bed and is received on the element during the continuous advancement of machine 1 and the element connected thereto. The ballast receiving and discharging element has discharge end 19 above transverse excavating chain course 15 for discharging the received ballast in the excavated ballast be portion immediately therebehind in the operating direction. Device 16 is arranged ahead of the transverse excavating chain course in the operating direction amd the ballast receiving and discharging element has a length extending from discharge end 19 to input or receiving end 20 immediately behind front undercarriage 4 in the operating direction.

Figure 8:
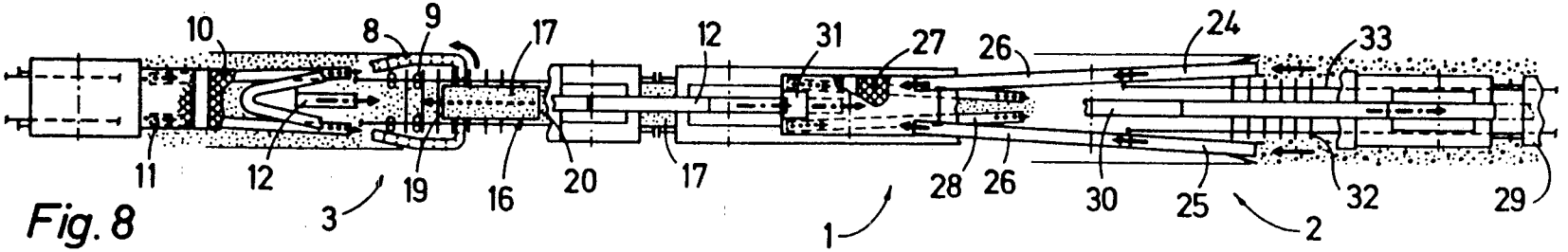

In the embodiment illustrated in FIGS. 7 and 8, leading shoulder ballast excavating machine 2 has a two-part machine frame 23 supported on three undercarriages 22, the two machine frame parts being pivotally coupled together at central undercarriage 22. The trailing machine frame part carries second vibratory ballast cleaning screen 27 preceding first ballast cleaning screen 10 in the operating direction for separating ballast received therein into a cleaned portion and a waste portion, and the leading machine frame part carries ballast excavating device 24, 25 on the sides of the machine frame at each side of track 7 for excavating ballast from each ballast bed shoulder portion and to convey the excavated ballast by conveyor bands 26 to second ballast cleaning screen 27.

A respective ballast redistributing conveyor band means 11, 28 is arranged to receive the cleaned ballast portion from each ballast cleaning screen 10, 27 and for redistributing the cleaned ballast portion, the ballast redistributing means arranged to receive the cleaned ballast portion from second ballast cleaning screen 27 including conveyor bands 28, 28 arranged to deposit the cleaned ballast portion on a track section preceding transverse excavating chain course 15 in the operating direction and, more particularly, in the center portion of ballast bed 18 for deposit thereon in front of ballast separating device 16 in the operating direction, device 16 being arranged between the first and second ballast cleaning screens. Furthermore, conveyors 12, 30 are mounted on machine frame means 5, 23 for receiving the waste portions from the first and second ballast cleaning screens and for removing the received waste portions to open-topped freight cars 29 preceding machine 1. Second ballast cleaning screen 27 comprises chute 31 at the rear end thereof for receiving oversized ballast rocks from the screen and this chute is incorporated into the conveying path of the waste portions between conveyor bands 12 mounted on machine frame 5 and conveyor bands 30 mounted on machine frame 23 to convey the waste portion from conveyor bands 12 to conveyor bands 30. All drives of shoulder ballast excavating machine 2 are controlled from central control panel 34.

A machine of this general type has been described and claimed in our simultaneously filed U.S. patent application entitled "MOBILE BALLAST CLEANING MACHINE ARRANGEMENT". This machine arrangement divides the cleaning of the excavated ballast over two screens and thus considerably enhances the operating capacity of the two machines while permitting the cleaned ballast portion of the leading shoulder ballast excavating machine to be stored temporarily on the center portion of the uncleaned ballast bed, and then to be simply separated and discharged in the transverse excavated ballast bed section behind the trailing transverse ballast excavating chain course. Since the ballast separating device bridges over this transverse excavating chain course, the cleaned ballast portion is discharged behind the transverse excavating chain course and this cleaned ballast portion is, therefore, not excavated again. Arranging the ballast separating device between the two ballast cleaning screens has the advantage that the two screens may be mounted at a considerable distance from each other, for example on two separate machines. The temporary storing of the cleaned ballast portion has the great advantage of doing away with expensive and long conveyors for conveying the cleaned ballast portion from the leading machine to the excavated transverse ballast bed section. In the illustrated machine arrangement, the excavated shoulder ballast is conveyed along the shortest possible conveying path to the second ballast cleaning screen and the cleaned ballast portion is redistributed from this screen to the center portion of the ballast bed for temporary storage. In this way, no shoulder ballast needs to be excavated by the transverse excavating chain course so that it is possible to excavate the entire ballast bed under the track, to clean the excavated ballast and to redistribute the cleaned ballast much more rapidly.

Device 16 illustrated in FIGS. 1 to 3 comprises two pairs 44, 45 of flanged wheels or rollers engaging track rails 33 and supporting the ballast receiving and discharging element thereon for continuous advancement along track 7, the two pairs of wheels being spaced from each other in the operating direction. This wheeled support assures a constant, very small spacing of device 16 from upper surfaces 35 of ties 32 during the continuous advancement so that a simple and problem-free separation of temporarily stored cleaned ballast portion 17 from underlying unclean ballast bed 18 is assured. At the same time, ballast separating device 16 will be automatically raised with track 7 when the same is raised by track lifting device 9. The illustrated ballast receiving and discharging element comprises conveyor band 37 extending in the track direction, conveying drive 47 for moving the conveyor band in this direction, ballast receiving shield 38 at end 20 opposite discharge end 19 and preceding conveyor band 37 in the operating direction, and vertically adjustable broom 39 rotatable about transverse axis 40 and arranged adjacent ballast receiving shield 38 for sweeping ballast 17 deposited on ballast bed 18 and upper surfaces 35 of ties 32 onto the ballast receiving shield. The ballast receiving shield has a leading end immediately above the plane defined by the upper surfaces of the ties. Drive 41 is linked to ballast sweeping broom 39 for raising and lowering the broom into a desired operating position. Conveying drive 47 is controllable to drive conveyor band 37 at a speed corresponding to the speed of the continuous advancement of machine 1. This has the advantage that the temporarily stored cleaned ballast portion remains substantially stationary as machine 1 and device 16 advance continuously and the cleaned ballast portion is received on, and discharged from, device 16. This avoids jamming, or lack of sufficient, ballast at receiving end 20. At the same time, a uniform ballast discharge will be assured, in dependence on the forward speed of the machine.

The ballast receiving and discharging element further comprises lateral retaining walls 42, 42 at each side of conveyor band 37 and extending from discharge end 19 to opposite end 20 along track rails 33, 33, and pairs of steering rods 43 link the retaining walls to machine frame 5, vertical adjustment drives 36 linking the steering rods to the machine frame. This construction of the ballast separating device is robust and assures a separation of cleaned ballast portion 17 from underlying unclean ballast bed 18 by combining the ballast receiving shield and associated ballast sweeping broom with the synchronously moving conveyor band which rapidly and frictionlessly moves the cleaned ballast portion to discharge end 19 in the range of transverse excavating chain course 15. The vertical adjustability of the ballast sweeping broom enables the operating position of the broom to be readily adapted to the height of cleaned ballast portion 17 deposited on the ballast bed and, also, to the extent of wear of the broom. The retaining walls at the sides of the conveyor band enable a considerable volume of ballast to be handled by device 16 without any danger of spilling ballast over the sides of the device and to be discharged only at the discharge end of the conveyor band. The vertically adjustable steering rods linking the ballast receiving and discharging element to the machine frame and the two pairs of flanged wheels supporting the lowered element on the track enable device 16 to be rapidly readjusted between a raised, inoperative position during movement of the machine between operating sites and a lowered, operative position at an operating site.

The ballast receiving and discharging element of device 16 further comprises vibrators 49 for imparting vibrations to the element in the track direction. This will reduce friction and will thus enable device 16 to be slid under cleaned ballast portion 17 more rapidly and easily. The vibrations will also facilitate the positioning of the cleaned ballast portion.

The flanged wheels of pair 45 trailing in the operating direction are transversely displaceable, and spreading drive 46 is connected to the flanged wheels for transversely displacing the same towards track rails 33, 33 engaged by these flanged wheels, which are a little wider than the flanged wheels of front pair 44. The flanged wheels of rear pair 45 are vertically adjustably mounted in retaining walls 42 by vertical adjustment drives 48. The flanged wheel support enables the ballast receiving and discharging element to be guided exactly parallel to upper surfaces 35 of ties 32, and the spreading drive enables the rear flanged wheels to be pressed into and out of engagement with the rails, as may be desired for guidance of device 16 along the track.

As can be seen in FIG. 1, ballast receiving shield 38 is inclined and its forward end extends to immediately above the plane defined by upper surfaces 35 of track ties 32 while the rear end of the shield is located at ballast receiving end 20. Track lifting device 9 raises track 7 off ballast bed 18 adjacent transversely extending ballast excavating chain course 15 and the ballast receiving and discharging element of device 16 has a length extending from discharge end 19 to input end 20 at a track section resting on ballast bed 18, this length corresponding preferably to at least one and a half times the length of transverse excavating chain course 15, i.e. about six crib widths or approximately 3.6 m. In the track section resting on ballast bed 18, machine frame 5 is supported by front undercarriage 4 and the ballast receiving and discharging element extends to a point immediately behind this undercarriage in the operating direction If the machine is not equipped with a track lifting device, the ballast receiving and discharging element preferably has a length corresponding to at least about one half the length of the transverse excavating chain course, i.e. about 1.2 m, and extends from discharge end 19 to input end 20 at a track section resting on ballast bed 18.

The above-indicated preferred lengths of the ballast receiving and discharging element are sufficient for separating substantially the entire volume of cleaned ballast portion 17 from underlying uncleaned ballast bed 18. This prevents a loss of cleaned ballast for redistribution in the excavated ballast bed portion under track 7, which is important because this excavated ballast bed portion has an increased volume due to the lifting of the track.

FIGS. 4 to 6 illustrate ballast separating device 65 whose ballast receiving and discharging element comprises substantially flat ballast separating bottom plate 69 extending substantially parallel to a plane defined by upper surfaces 84 of track ties 85 and adjacent thereto. The bottom plate has lateral edges adjacent track rails 33 and two lateral retaining walls 77, 77 extend from the lateral bottom plate edges, the bottom wall and the retaining walls defining trough 70 open on top and its discharge end 83 and end 82 opposite thereto. Driven conveyor band 75 is mounted in trough 70 and extends substantially parallel to bottom plate 69 from the discharge end to the opposite end in the track direction. Conveying drive 74 moves conveyor band 75 in this direction, and transversely extending ballast entrainment elements 76 are carried by the conveyor band. The ballast entrainment elements reach to the bottom plate to entrain the cleaned ballast portion received thereon. As in the previously described embodiment, conveying drive 74 is controllable to drive the conveyor band at a speed corresponding to the speed of the continuous advancement of the machine in an operating direction indicated by arrow 63. The pairs of flanged wheels 78 are journaled in lateral retaining walls 77 at the outsides thereof for supporting trough 70 on the track, and pairs of steering rods 79 are connected to the flanged wheels and link the retaining walls to machine frame 58. As in the previously described embodiment, vertical adjustment drives 80 link the steering rods to the machine frame, and two pairs of flanged wheels 78 are spaced from each other in the operating direction. Also, vibrators 81 driven by drives 80 impart longitudinally oriented vibrations to device 65. As shown in FIG. 5, opposite end 82 of bottom plate 69 is serrated.

Such a ballast separating device is very advantageous since the flat ballast separating bottom plate only slightly lifts separated cleaned ballast portion 66 off underlying uncleaned ballast bed 68 during the continuous advancement thereof, with a minimal expenditure of energy. The trough can be very robustly constructed at relatively low cost. The conveyor band with its entrainment elements assures rapid discharge of the cleaned ballast portion.

The operation of ballast cleaning machine arrangement 1 will now be explained in more detail in connection with FIGS. 1-3, 7 and 8:

When the machine arrangement has reached the operating site, shoulder ballast excavating devices 24, 25 and ballast excavating chain 8 are lowered into their operating positions and transverse excavating chain course 15 is inserted under track 7. At the same time, track lifting device 9 is operated to engage the trail rails and to raise the track sufficiently to enable transverse excavating chain course 15 to be positioned under the track and to be connected to the descending and ascending courses of the endless excavating chain. Ballast separating device 16 is then lowered by first operating drives 48 for vertically adjusting rear pair 45 of flanged wheels and then operating drives 36 until the rear flanged wheels engage track rails 33. Spreading drive 46 is then operated to spread the rear flanged wheels until device 46 is properly centered and the flanges of the wheels engage the gage sides of the rails. Subsequently, vertical adjustment drives 36 are further operated until the front flanged wheels of pair 44 engage the track rails. As soon as all the drives for moving not only the ballast excavating chain 8 and devices 24, 25, as well as the vibrating drives for ballast cleaning screens 10 and 27, but also conveyor bands 11, 12, 16, 28, 30 are operated, forward drives 6 and 21 are actuated so that machine arrangement 1 continuously advances along track 7 in the operating direction indicated by arrow 13. As indicated by arrows in FIGS. 7 and 8, the encrusted shoulder ballast is excavated by excavating devices 24, 25 and is conveyed by conveyor bands 26 to second ballast cleaning screen 27. The ballast in the center portion of the ballast bed under ties 32 remains in place uncleaned and has been designated by reference numeral 18 to form a ballast layer underlying cleaned ballast portion 17 received from screen 27 and deposited by ballast redistributing conveyor bands 28 between track rails 33, 33 in a center portion of the ballast bed.

At the same time and while cleaned ballast portion is temporarily stored on the uncleaned ballast bed, trailing ballast excavating chain 8 excavates a transverse portion of the uncleaned ballast bed under the track and conveys the excavated ballast to first ballast cleaning screen 10. As shown by small dotted arrows, the cleaned ballast portion from screen 10 is redistributed by pivotal conveyor bands 11 in the excavated ballast bed shoulders while its waste portion is removed along a conveying path indicated by chain-dotted arrows by conveyor band 12, through chute 31 and conveyor band 30 to freight cars 29 which precede machine arrangement 1. Simultaneously, device 16 will continuously receive and discharge cleaned ballast portion 17 as it separates the same from underlying ballast bed 18. This will be effected by the upwardly inclined ballast receiving shield 38 displacing the cleaned ballast portion onto driven conveyor band 37 which bridges transverse excavating chain course 15 and discharges the cleaned ballast portion in the continuously advancing excavated ballast bed gap immediately behind the transverse excavating chain course between rails 33. Rotating broom 39 aids in moving the cleaned ballast portion up the ballast receiving shield and onto the driven conveyor band while the longitudinally oriented vibrations imparted to the device by vibrators 49 reduce the friction and thus enhance the conveyance of the cleaned ballast portion.

Figure 9:
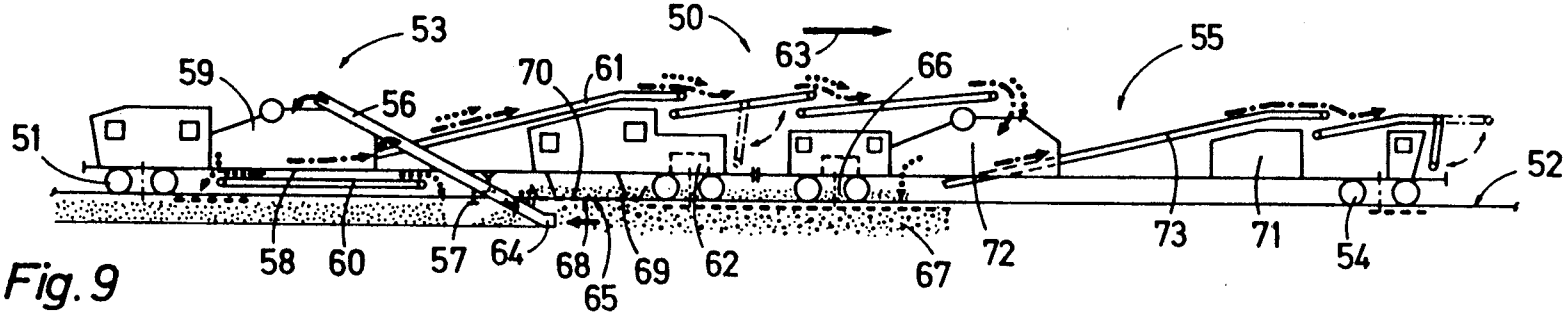
FIG. 9 shows a diagrammatic side view of a mobile ballast cleaning machine equipped with the separating device of FIGS. 4 to 6.

Ballast cleaning machine 50 illustrated in FIG. 9 and incorporating ballast separating device 65 of FIGS. 4-6 operate in the following manner:

The ballast cleaning machine advances continuously along track 52 in an operating direction indicated by arrow 63. It is comprised of trailing ballast cleaning machine 53 supported by widely spaced undercarriages 51 on the track and leading machine 55 coupled to machine 53 and supported by undercarriages 54 on the track. Vertically adjustable ballast excavating chain 56 excavates ballast 67 under the track with transverse excavating chain course 64 inserted under the track and track lifting device 57 is mounted on machine frame 58 adjacent the transverse ballast excavating chain course. As indicated by small arrows, the excavated ballast is conveyed by the endless excavating chain to vibratory ballast cleaning screen 59 also mounted on the machine frame. A fraction of the cleaned ballast from screen 59 is redistributed to the track shoulders by pivoting ballast redistributing conveyor band 60, as shown by small dotted arrows, while the remaining fraction of the cleaned ballast portion is conveyed, together with the waste portion, to preceding ballast cleaning screen 72 by conveyor band 61, as shown by chain-dotted arrows.

There, the cleaned and waste portions are cleaned again. Drive 62 continuously propels the machine in the operating direction and ballast separating device 65 is vertically adjustably mounted on machine frame 58 between front undercarriage 51 and transverse excavating chain course 64. Ballast cleaning screen 72 is mounted on leading machine 55. The cleaned ballast portion from screen 72 is redistributed between track rails 86, 86 under track 52 to form cleaned ballast portion 66 on underlying ballast bed 67 while the waste portion from the ballast cleaning screens is removed in a forward direction along a conveying path indicated by chain-dotted arrows. The cleaned ballast portion 67 is continuously separated from underlying ballast bed 66 as bottom ballast separating plate 69 continuously advances with machine arrangement 50. The serrated forward end of the bottom plate will help to scoop up and slightly raise cleaned ballast portion 67 and driven conveyor band 75 with its entrainment elements 76 will discharge the separated cleaned ballast portion at discharge end 83.

The machine arrangement may be modified to convey a fraction of the ballast excavated by chain 56 to trailing ballast cleaning screen 59 while the remaining excavated ballast fraction is conveyed to leading ballast cleaning screen 72. In this case, the waste portions coming from the two screens are separately removed by respective waste portion conveyors.

What is claimed is:

1. In combination with a mobile ballast cleaning machine advancing continuously in an operating direction along a railroad track comprised of two rails fastened to upper surfaces of a succession of ties supported on a ballast bed and comprising a machine frame and a ballast excavating chain mounted on the machine frame, the chain including a transverse course extending under the track and driven to excavate a transversely extending portion of the ballast bed during the continuous advancement of the machine: a device connected to the machine for continuous advancement therewith and arranged to receive ballast deposited on the ballast bed and the ties ahead of the transverse ballast excavating chain course in the operating direction and to discharge the received ballast in the transversely extending excavated ballast bed portion, the device comprising (a) a ballast receiving and discharging element extending substantially parallel to the track, and (b) a vertical adjustment drive means linking the ballast receiving and discharging element to the machine frame and arranged to lower the element onto the upper surfaces of the ties between the rails whereby the ballast deposited on the ballast bed and the ties is separated from a portion of the ballast bed underlying the deposited ballast and is received on the element during the continuous advancement of the machine and the element connected thereto, (c) the ballast receiving and discharging element having a discharge end above the transverse ballast excavating chain course for discharging the received ballast in the excavated ballast bed portion immediately therebehind in the operating direction.

2. In the combination of claim 1, the device being preceding the transverse excavating chain course in the operating direction.

3. In the combination of claim 1, the device further comprising at least one pair of wheels engaging the track rails and supporting the ballast receiving and discharging element thereon for continuous advancement along the track.

4. In the combination of claim 3, the ballast receiving and discharging element comprising a conveyor band extending substantially parallel to the track, a conveying drive for moving the conveyor band, a ballast receiving shield at an end opposite the discharge end and preceding the conveyor band in the operating direction, the ballast receiving shield having a leading end immediately above a plane defined by the upper surfaces of the ties, and a vertically adjustable broom rotatable about a transverse axis and arranged adjacent the ballast receiving shield for sweeping the ballast deposited on the ballast bed and the upper surfaces of the ties on the ballast receiving shield.

5. In the combination of claim 4, the conveying drive being controllable to drive the conveyor band at a speed corresponding to the speed of the continuous advancement of the machine.

6. In the combination of claim 4, the ballast receiving and discharging element further comprising lateral retaining walls at each side of the conveyor band and extending from the discharge end to the opposite end along the track rails, pairs of steering rods linking the retaining walls to the machine frame, the vertical adjustment drive means linking the steering rods to the machine frame, and two of said pairs of flanged wheels being spaced from each other in the operating direction and supporting the ballast receiving and discharging element on the track rails.

7. In the combination of claim 6, the flanged wheels of the pair trailing in the operating direction being transversely displaceable, and further comprising a spreading drive for transversely displacing the flanged wheels of the trailing pair towards the track rails engaged thereby.

8. In the combination of claim 3, the ballast receiving and discharging element comprising a substantially flat ballast separating bottom plate extending substantially parallel to a plane defined by the upper surfaces of the ties and adjacent thereto, the separating bottom plate having lateral edges adjacent the track rails, two lateral retaining walls extending from the lateral bottom plate edges, the bottom plate and the retaining walls defining a trough open on top and at the discharge end and an end opposite thereto, and a driven conveyor band mounted in the trough and extending substantially parallel to the bottom plate from the discharge end to the opposite end substantially parallel to the track, a conveying drive for moving the conveyor band, and transversely extending ballast entrainment elements carried by the conveyor band.

9. In the combination of claim 8, the opposite end of the bottom plate being serrated.

10. In the combination of claim 8, the conveying drive being controllable to drive the conveyor band at a speed corresponding to the speed of the continuous advancement of the machine.

11. In the combination of claim 8, the ballast receiving and discharging element further comprising pairs of steering rods linking the retaining walls to the machine frame, the vertical adjustment drive means linking the steering rods to the machine frame, and two of said pairs of flanged wheels being spaced from each other in the operating direction and supporting the ballast receiving and discharging element on the track rails.

12. In the combination of claim 11, the flanged wheels of the pair trailing in the operating direction being transversely displaceable, and further comprising a spreading drive for transversely displacing the flanged wheels of the trailing pair towards the track rails engaged thereby.

13. In the combination of claim 1, the machine further comprising a track lifting device mounted on the machine frame for continuously engaging the track rails and raising the track off the ballast bed adjacent the transversely extending ballast excavating chain course.

14. In the combination of claim 13, the ballast receiving and discharging element having a length extending from the discharge end to an input end at a track section resting on the ballast bed.

15. In the combination of claim 14, the length of the ballast receiving and discharging element corresponding to at least one and a half times the length of the transverse excavating chain course.

16. In the combination of claim 13, the machine frame being supported by an undercarriage in said track section and the ballast receiving and discharging element extending to a point immediately behind the undercarriage in the operating direction.

17. In the combination of claim 1, the ballast receiving and discharging element having a length corresponding to at least about one half the length of the transverse excavating chain course and extending from the discharge end to an input end at a track section resting on the ballast bed.

18. In the combination of claim 1, the ballast receiving and discharging element further comprising a vibrator for vibrating the element in the track direction.

* * * * *